US012644280B2

(12) United States Patent
Nilsson et al.

(10) Patent No.: US 12,644,280 B2
(45) Date of Patent: Jun. 2, 2026

(54) GRID OF PROFILES

(71) Applicant: SAINT-GOBAIN ECOPHON AB, Hyllinge (SE)

(72) Inventors: Thomas Nilsson, Helsingborg (SE); Maximilian Gruber, Helsingborg (SE)

(73) Assignee: SAINT-GOBAIN ECOPHON AB, Hyllinge (SE)

( * ) Notice: Subject to any disclaimer, the term of this patent is extended or adjusted under 35 U.S.C. 154(b) by 348 days.

(21) Appl. No.: 18/574,285

(22) PCT Filed: Jun. 14, 2022

(86) PCT No.: PCT/EP2022/066156

§ 371 (c)(1),
(2) Date: Dec. 26, 2023

(87) PCT Pub. No.: WO2023/274715

PCT Pub. Date: Jan. 5, 2023

(65) Prior Publication Data

US 2024/0279925 A1 Aug. 22, 2024

(30) Foreign Application Priority Data

Jul. 1, 2021 (EP) ..... 21183134

(51) Int. Cl.

| | |
|---|---|
| ***E04B 9/16*** | (2006.01) |
| ***E04B 9/18*** | (2006.01) |
| *E04B 9/06* | (2006.01) |

(52) U.S. Cl.

CPC ..... *E04B 9/16* (2013.01); *E04B 9/18* (2013.01); *E04B 9/068* (2013.01)

(58) Field of Classification Search

CPC ..... E04B 9/16; E04B 9/18; E04B 9/068

(Continued)

(56) References Cited

U.S. PATENT DOCUMENTS 2,303,269 A * 11/1942 Goss ..... E04B 9/16 52/327
2,499,278 A * 2/1950 Anders ..... E04B 9/16 52/309.1

(Continued)

FOREIGN PATENT DOCUMENTS

DK 2573290 T3 * 11/2015 ..... E04B 9/067
FR 2966851 A1 * 5/2012 ..... E04B 1/941

(Continued)

OTHER PUBLICATIONS

International Search Report issued in corresponding International Patent Application No. PCT/EP2022/066156 dated Sep. 21, 2022.

*Primary Examiner* — Brian D Mattei
*Assistant Examiner* — Joseph J. Sadlon
(74) *Attorney, Agent, or Firm* — Morgan, Lewis & Bockius LLP

(57) ABSTRACT

The present disclosure relates to a grid of profiles with a primary profile provided with a bulb portion extending in a longitudinal direction of the primary profile, a secondary profile comprising a connector at an end of the secondary profile, and a connection clip comprising a base portion configured for mounting to the bulb portion of the primary profile and a projecting flange provided with an opening, the opening being configured for reception of the connector of the secondary profile from a first side of the projecting flange and also a connector of an opposing secondary profile from a second side of the projecting flange.

16 Claims, 7 Drawing Sheets

(58) Field of Classification Search
USPC ..... 52/506.07
See application file for complete search history.

(56) References Cited

U.S. PATENT DOCUMENTS 3,496,690 A * 2/1970 Reinhardt ..... E04B 9/064 52/506.07
3,774,366 A * 11/1973 Baker ..... E04B 9/064 52/669
3,816,880 A * 6/1974 Jacobs ..... E04B 9/006 362/150
3,898,782 A * 8/1975 Donato ..... E04B 9/064 403/217
3,984,505 A * 10/1976 Gutermuth ..... B01D 47/06 55/DIG. 36
4,041,668 A * 8/1977 Jahn ..... E04B 9/16 52/506.09
4,126,971 A * 11/1978 Macuga ..... E04B 9/12 52/28
4,541,216 A * 9/1985 Head ..... E04B 9/26 52/772
4,640,077 A * 2/1987 Hall ..... E04B 9/127 52/506.06
4,723,749 A * 2/1988 Carraro ..... E04B 9/18 52/39
4,726,165 A * 2/1988 Brinsa ..... E04B 9/26 52/713
4,920,719 A * 5/1990 Shaub ..... E04B 9/064 52/506.08
5,823,484 A * 10/1998 Barnard ..... B64C 1/406 248/65
5,893,249 A * 4/1999 Peterson ..... F16B 7/0486 52/506.07
6,230,464 B1 * 5/2001 Vrame ..... E04B 9/006 52/506.07
7,264,214 B2 * 9/2007 Oh ..... A62C 35/68 248/65
7,552,567 B2 * 6/2009 Ingratta ..... E04B 9/06 52/506.07
7,716,892 B2 * 5/2010 Kim ..... E04B 9/16 52/311.1
8,341,913 B2 * 1/2013 Meres ..... E04B 9/241 52/489.1
8,474,200 B2 * 7/2013 Gerkes ..... E04B 9/006 52/655.1
8,985,350 B2 * 3/2015 Thrush ..... A47B 96/025 211/175
9,091,051 B2 * 7/2015 Baxter ..... E04B 9/067
9,279,253 B1 * 3/2016 Gaydos ..... E04B 9/0442
10,106,982 B2 * 10/2018 Corpolongo ..... E04B 9/068
10,405,942 B2 * 9/2019 Schreiber ..... A61B 90/35
10,947,725 B2 * 3/2021 Lin ..... E04B 9/006
11,428,000 B2 * 8/2022 Jung ..... E04B 9/0478
11,525,261 B2 * 12/2022 Neal ..... E04B 9/12
11,821,203 B2 * 11/2023 Pollenus ..... E04B 9/001
11,834,828 B2 * 12/2023 Heesbeen ..... E04B 9/16
12,134,893 B2 * 11/2024 Oleske ..... E04B 9/001
2006/0005495 A1 * 1/2006 Stessel ..... E04B 9/24 52/506.07
2011/0011023 A1 * 1/2011 Gulbrandsen ..... E04B 9/065 52/506.07
2021/0285212 A1 * 9/2021 Zhang ..... E04B 9/10
2023/0332425 A1 * 10/2023 Saidian ..... E04B 9/183

FOREIGN PATENT DOCUMENTS

JP S56-171920 U 12/1981
JP S6117131 Y2 * 5/1986
JP H06-73832 A 3/1994
KR 20030096201 A * 12/2003
WO 2015/050448 A1 4/2015

* cited by examiner

GRID OF PROFILES

CROSS-REFERENCE TO RELATED APPLICATION

The present application is a 35 U.S.C. 371 national phase application of PCT International Application No. PCT/EP2022/066156, filed on Jun. 14, 2022, which claims priority to European Patent Application No. 21183134.2, filed on Jul. 1, 2021, both of which are incorporated herein by reference in their entireties as a part of the present application.

FIELD OF THE INVENTION

The present invention relates to suspended ceiling systems and more particularly to a grid of profiles for a suspended ceiling system.

BACKGROUND ART

Suspended ceiling systems are commonly used products in many different types of buildings in order to provide an aesthetically pleasing interior ceiling and/or for providing a desired functionality such as sound dampening and/or for supporting building equipment such as ventilation ducts or electrical wiring.

A suspended ceiling system usually comprises a grid of profiles that supports a number of ceiling tiles, the grid of profiles being attached to a structural ceiling in the building. The ceiling tiles are typically made of a mineral fibre material, such as glass wool but other types of ceiling tiles are also produced.

The grid of profiles usually comprises a number of profiles in the shape of main runners that extend in parallel, the main runners being connected to the structural ceiling. Cross runners may further be provided which extend between the main runners, providing increased rigidity to the grid of profiles. The cross runners may further facilitate achieving the desired spacing between the main runners.

Sometimes it is necessary however to further increase the rigidity of the grid of profiles and to provide ways of increasing rigidity in applications in which no cross runners are used in the grid of profiles, as this is not always suitable. Manufacturers of suspended ceiling system constantly strive to provide grids of profiles that can achieve the desired or an improved function while reducing the manufacturing costs and material usage. Thus, there is a need for a more versatile grid of profiles that uses less manufacturing materials, has low manufacturing cost and that can provide sufficient rigidity.

Relevant prior art may be found in WO2015/050448A1.

SUMMARY OF THE INVENTION

In view of that stated above, the object of the present invention is to provide a grid of profiles that mitigates some of the problems with prior art solutions.

To achieve at least one of the above objects and also other objects that will be evident from the following description, a grid of profiles having the features defined in claim 1 is provided according to the present disclosure. Preferred embodiments of the device will be evident from the dependent claims.

More specifically, there is provided a grid of profiles for a suspended ceiling system comprising:

a primary profile provided with a bulb portion extending in a longitudinal direction of the primary profile, a secondary profile comprising a connector at an end of the secondary profile, a connection clip comprising a base portion configured for mounting to the bulb portion of the primary profile and a projecting flange provided with an opening. The opening being configured for reception of the connector of the secondary profile from a first side of the projecting flange and also a connector of an opposing secondary profile from a second side of the projecting flange. The connection clip is mounted to the bulb portion of the primary profile and the connector of the secondary profile is inserted into the opening of projecting flange such that the secondary profile is connected to the primary profile via the connection clip at a secondary profile level which is different from a primary profile level in which the primary profile extends.

The grid of profiles can thus be provided with secondary profiles that improve the rigidity of the grid of profiles. The connection clip facilitates flexible arrangement of the secondary profiles in relation to the primary profiles and reduces time required for installing the grid of profiles.

The primary profile may be formed by a main runner or by a cross runner of the grid of profiles.

The connection clip may be snap fit mounted to the bulb portion of the primary profile, securing the connection clip in a reliable and quick manner to the primary profile at a position where a secondary profile is desired.

The primary profile may have an inverted T-shaped profile with an upstanding web and laterally extending flanges, the bulb portion being arranged at a free end of the web.

The secondary profile may further have an inverted T-shaped profile with an upstanding web and laterally extending flanges.

The primary profile may be provided with a plurality of openings distributed along the longitudinal direction of the primary profile, each opening being configured for connection of an additional profile to the primary profile at the primary profile level. The grid of profiles may thus be provided with secondary profiles at a secondary profile level in addition to the additional profiles that are arranged on the primary profile level, facilitating providing increased rigidity to the grid of profiles.

Each of the plurality of openings of the primary profile may have the same configuration as the opening of the projecting flange of the connection clip.

The opening of the projecting flange may be aligned with one of the plurality of openings in the primary profile, allowing the secondary profiles to be arranged at a predetermined position on the primary profile and for instance over an additional profile.

The base portion of the connection clip may comprise a registering element member configured to engage with one of the plurality of openings in the primary profile, thus facilitating that the connection clip can be aligned with one of the plurality of opening in the primary profile.

The connection clip may be made out of metal, for instance spring steel.

The grid of profiles may be configured for supporting a ceiling tile by the primary profile.

The grid of profiles may comprise a plurality of primary profiles and a plurality of secondary profiles.

The grid of profiles may further comprise at least one suspension element connecting the primary profile to a structural ceiling.

The opening of the projecting flange on the connection clip may be oriented such that the secondary profile extends perpendicularly in relation to the primary profile, providing a grid of profiles where openings between the primary profiles and the secondary profiles are rectangular.

The opening of the projecting flange on the connection clip may further be oriented such that the secondary profile is vertically separated from the primary profile. The vertical separation allows greater vertical distance between the primary profile and the associated secondary profiles, which in certain application can be beneficial for instance to accommodate building utility equipment between the primary profile and the secondary profiles.

The opening of the projecting flange on the connection clip may further be oriented such that the secondary profile and the primary profile vertically overlap. The secondary profiles may in such an application provide increased rigidity to the grid of profiles, as the secondary profiles can prevent excessive lateral movement of the primary profile.

The opening of the projecting flange on the connection clip may be oriented such that the secondary profile extends at a vertical angle in relation to the primary profile.

Generally, all terms used in the claims are to be interpreted according to their ordinary meaning in the technical field, unless explicitly defined otherwise herein. All references to "a/an/the [element, device, component, means, step, etc]" are to be interpreted openly as referring to at least one instance of said element, device, component, means, step, etc., unless explicitly stated otherwise. The steps of any method disclosed herein do not have to be performed in the exact order disclosed, unless explicitly stated.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein.

DESCRIPTION OF EMBODIMENTS

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1:
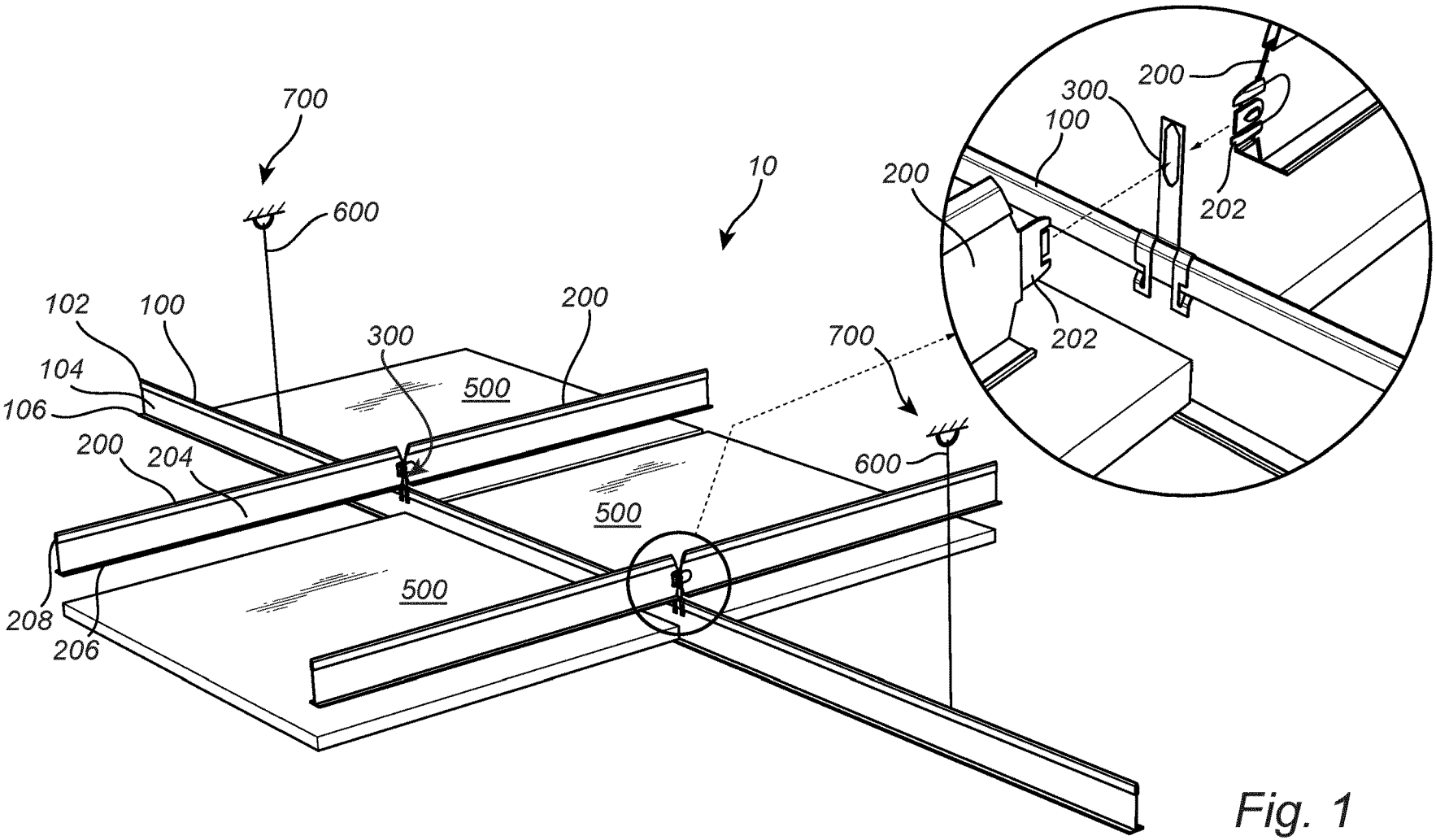
FIG. 1 discloses a perspective view of a grid of profiles.

FIG. 1 discloses a grid of profiles 10 for a suspended ceiling system. The grid of profiles 10 comprises a primary profile 100. The primary profile 100 may be a profile of the grid of profiles 10 that is connected to a structural ceiling 700 of a building in which the grid of profiles 10 is arranged, i.e. the primary profile may be a main runner in the grid of profiles. Typically, the primary profile 100 is the load bearing profile which supports the remaining components of the grid of profiles 10 directly or indirectly. Alternatively, the primary profile may be a cross runner in the grid of profiles.

The grid of profiles 10 may be provided with suspension elements 600 connecting the grid of profiles 10 to the structural ceiling 700, preferably from the primary profiles 100. The suspension element 600 may be any type of element that is suitable for connecting the grid of profiles 10 to the ceiling 700 and may further be adjustable in order to achieve a level grid of profiles 10 etc.

The remaining components of the grid of profiles are either directly or indirectly supported by the primary profiles 100, as mentioned. Naturally however, other components of the grid of profiles 10 than the primary profiles 100 may also be suspended from the structural ceiling 700 in a similar manner as for the primary profiles 100.

Only one primary profile 100 is shown but a plurality of primary profiles 100 may be provided, preferably extending in parallel with a desired spacing between every two primary profiles 100. The primary profile 100 may be provided with end connectors enabling interconnecting two primary profiles end-to-end such that they extend along a common longitudinal axis. The grid of profiles 10 may be configured to support a ceiling tile 500, preferably a plurality of ceiling tiles 500. The ceiling tiles 500 may be manufactured from a mineral fibre material such as glass wool. The ceiling tiles 500 may be arranged to be supported by the primary profiles 100 and/or additional profiles 400 arranged at the same level as the primary profiles 100. Alternatively, or in addition, ceiling tiles 500 may be provided supported by the secondary profiles 200.

The primary profile 100 is preferably made from a metallic material such as steel or aluminium but may also be made from for instance a plastic material.

The primary profile 100 is provided with a bulb portion 102 extending in a longitudinal direction of the primary profile 100. The bulb portion 102 is preferably arranged uppermost on the primary profile 100. Further still, the primary profile 100 may have an inverted T-shaped profile with an upstanding web 104 and laterally extending flanges 106, where the bulb portion 102 may be arranged at a free end of the web 104. The laterally extending flanges 106 may be configured for supporting the ceiling tiles 500.

The grid of profiles 10 further comprises a secondary profile 200. The secondary profiles 200 provide rigidity to the grid of profiles 10 as they extend at an angle in relation to the primary profiles 100.

The secondary profile 200 is preferably made from a metallic material such as steel or aluminium but may also be made from for instance a plastic material. The secondary profile 200 may have an inverted T-shaped profile with an upstanding web 204 and laterally extending flanges 206. The secondary profile 200 may comprise a bulb portion 208 at a free end of the upstanding web 204. The secondary profile 200 may be provided with the same profile as the primary profile 100.

The secondary profile 200 may further comprise a connector 202 at an end of the secondary profile 200. The opposing end of the secondary profile 200 may be provided with a corresponding connector 202.

The grid of profiles further comprises a connection clip 300. The connection clip 300 facilitates connection of the secondary profile 200 to the primary profile 100 and further allows that the secondary profile 200 can be arranged vertically offset from the primary profile 100.

The connection clip 200 comprises a base portion 302 configured for mounting to the bulb portion 102 of the primary profile and a projecting flange 304 provided with an opening 306. The connection clip is preferably made from a resilient material such as steel, e.g. spring steel. It may also be made from a plastic material.

The projecting flange 304 may be configured to protrude in an upwardly direction or at an angle depending on the desired orientation of the secondary profile 200 in relation to the primary profile 100, as will be elaborated further on below.

The opening 306 in the projecting flange is configured for reception of the connector 202 of the secondary profile 200 from a first side 304*a* of the projecting flange 304 and also a connector 202 of an opposing secondary profile 200 from a second side 304*b* of the projecting flange 304. The secondary profile 200 can thus be connected to the connection clip 300. Preferably, the connector 202 is configured to snap-lock to the projecting flange 304 once inserted into the opening 306. The connector 202 may be configured for interlocking with a corresponding connector 202 when these are connected to the connection clip 300 from opposing sides.

The connection clip 300 is mounted to the bulb portion 102 of the primary profile 100 and the connector 202 of the secondary profile 200 is inserted into the opening 306 of projecting flange 304 such that the secondary profile is connected to the primary profile 100 via the connection clip 300 at a secondary profile 200 level which is different from a primary profile level in which the primary profile 100 extends. The level of the primary profiles 100 and the secondary profiles 200 respectively can be interpreted as the respective essentially horizontal plane on which the underside of the respective profiles 100, 200 extends in.

The grid of profiles 10 can be made more rigid by the provision of the secondary profiles 200. The secondary profiles 200 may further facilitate achieving the desired spacing between the primary profiles 100. Moreover, the connection clip 300 allows the positioning of the secondary profiles 200 in relation to the primary profiles 100 to be easily varied, as each connection clip 300 can be attached at any desired position along the length of the primary profile 100.

Figure 2:
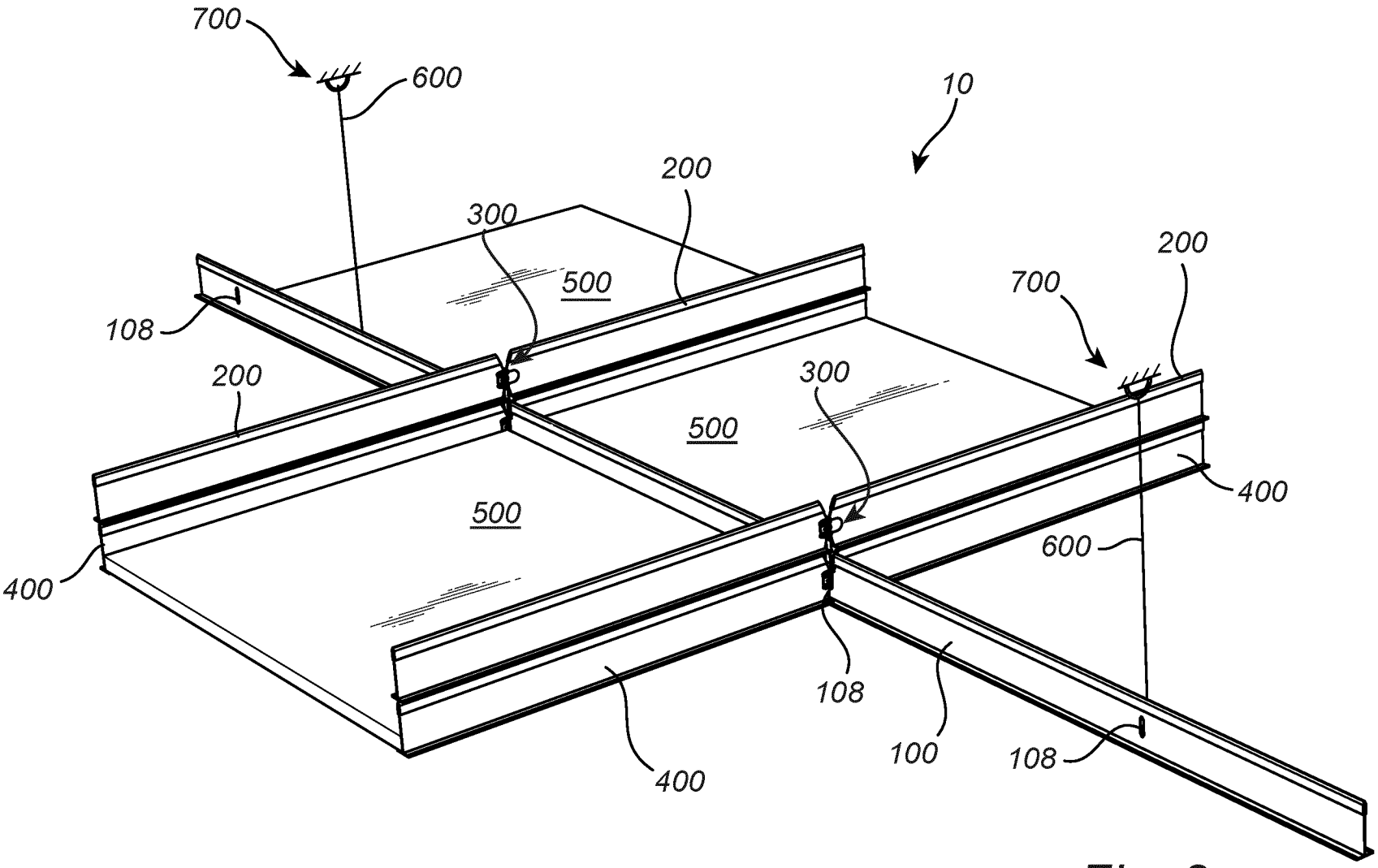
FIG. 2 discloses a perspective view of a grid of profiles.

The level of the secondary profiles 200 may be such that the secondary profiles are arranged entirely above the primary profiles 100, as is illustrated in FIGS. 1 and 2.

The opening 306 of the projecting flange 304 on the connection clip 300 may be oriented such that the secondary profile 200 extends perpendicularly in relation to the primary profile 100, thus forming a grid 10 having rectangular openings between the primary profiles 100 and the secondary profiles 200.

In FIG. 2 is another embodiment illustrated in which the grid of profiles 10 is provided with additional profiles 400 extending in the primary profile 100 level. The primary profile 100 may be provided with a plurality of openings 108 distributed along the longitudinal direction of the primary profile 100. Each opening 108 being configured for connection of an additional profile 400 to the primary profile 100 at the primary profile level. In other words, the additional profiles 400 may form cross runners that extend in essentially the same level as the primary profiles 100. The combination of additional profiles 400 and the secondary profiles 200 provides high rigidity to the grid of profiles 10 and the flexibility of the placement of the connection clip 300 on the primary profiles 100 allows each secondary profile 200 to be arranged as desired, for instance where it can contribute the most to the improved rigidity.

In FIG. 2, the secondary profiles 200 are arranged directly above the additional profiles 400. The secondary profiles 200 may be connected to the additional profiles 400 by means of connectors, such as clips, thereby improving the load bearing capacity of the additional profiles 400.

The secondary profiles 200 does not have to be arranged above an additional profile 400 but can be arranged for instance between two additional profiles 400 or at any desired position along the length of the primary profile 100, giving great flexibility to reinforce the grid of profiles 10 where needed. Such an arrangement may also be used for securing a ceiling tile in the grid of profiles and may be used for instance in a venue for physical activities, such as a sports hall, having a suspended ceiling. The provision of a secondary profiles between two additional profiles, i.e. the secondary profile being arranged with an offset with regard to the additional profiles, hereby forms an impact protection preventing displacement of the ceiling tile in the event of an impact to the suspended ceiling from below, such as from a ball hitting the ceiling tile.

Each of the plurality of openings 108 of the primary profile 100 may have the same configuration as the opening 306 of the projecting flange 304 of the connection clip 300.

The additional profiles 400 are preferably made from a metallic material such as steel or aluminium but may also be made from for instance a plastic material. The additional profiles 400 may have an inverted T-shaped profile with an upstanding web and laterally extending flanges and comprise a bulb portion at a free end of the upstanding web. The additional profiles 400 may be provided with the same profile as the primary profile 100. The additional profiles 400 and the secondary profiles 200 may be of the same type.

Figure 3:
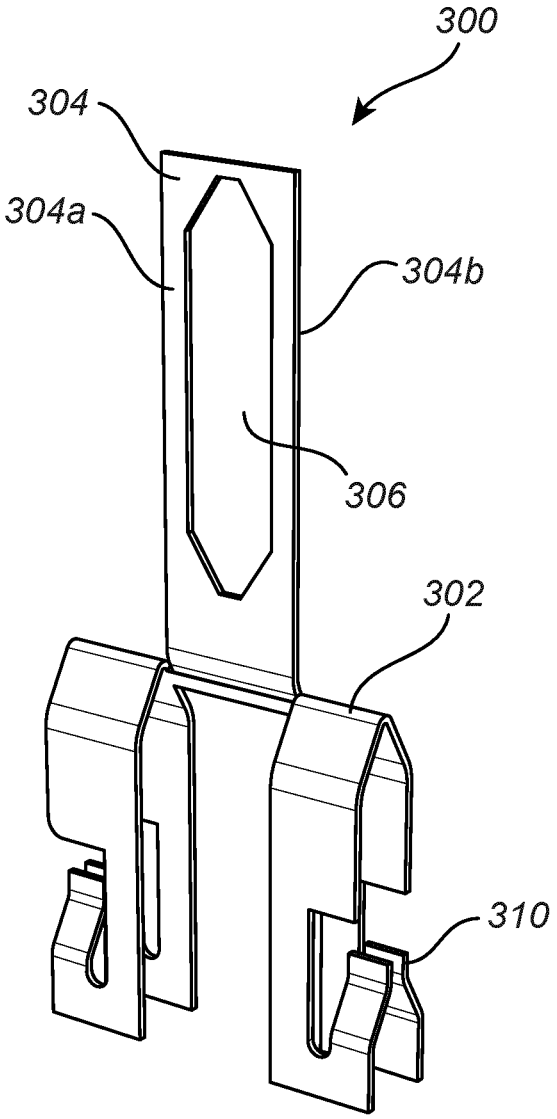
FIG. 3 discloses a perspective view of a connection clip.

Turning to FIG. 3 in which a connection clip 300 is shown in a perspective view. The connection clip 300 is preferably configured for snap fit mounting to the bulb portion of the 102 of the primary profiles 100. The connection clip 300 may for the purpose of snap fit mounting comprise snap fit members 310 extending from the base portion 302 in an upwardly direction, in the direction of the projecting flange 304.

Two snap fit members 310 may be arranged at each lateral side of the base portion 302 and forming between them a narrowing space, as each snap fit member 310 extends upwards and towards the opposite snap fit member 310 on the same lateral side of the base portion 302. The snap fit members 310 will thus be pushed aside as the connection clip 300 is brought over the bulb portion 102 of the primary profile 100, whereafter the snap fit members 310 will resiliently return to a locking position after having passed over the bulb portion 102, whereby the snap lock members 310 will lockingly engage the side of the bulb portion 102 facing the laterally extending web 106 preventing the connection clip 300 to be removed from the primary profile 100. In order to remove the connection clip 300, the snap fit members 310 must be bent open or the connection clip 300 slid longitudinally of an end of the primary profile 100.

The base portion 302 of the connection clip 300 is configured to accommodate the bulb portion 102 and may thus be provided at least partly with a corresponding shape. The base portion 302 having a corresponding shape as the bulb portion 102 reduces play between the connection clip 300 and the primary profile 100, making the grid of profiles 10 more stable.

Moreover, the height of the projecting flange 304 along with the position of the opening 306 in relation to the base portion 302 may be different for different applications, in order to achieve a desired difference between the level of the primary profiles 100 and the level of the secondary profiles 200. The grid of profiles 10 may thus be adapted to accommodate a larger variety of ceiling tiles or other equipment.

The connection clip 300 is preferably made in one piece. It may be manufactured by a bending operation and/or stamping operation from a piece of suitably cut sheet material, such as sheet spring steel etc. It may also be made in a moulding operation for instance if the connection clip 300 is made from a plastic material.

Figure 4:
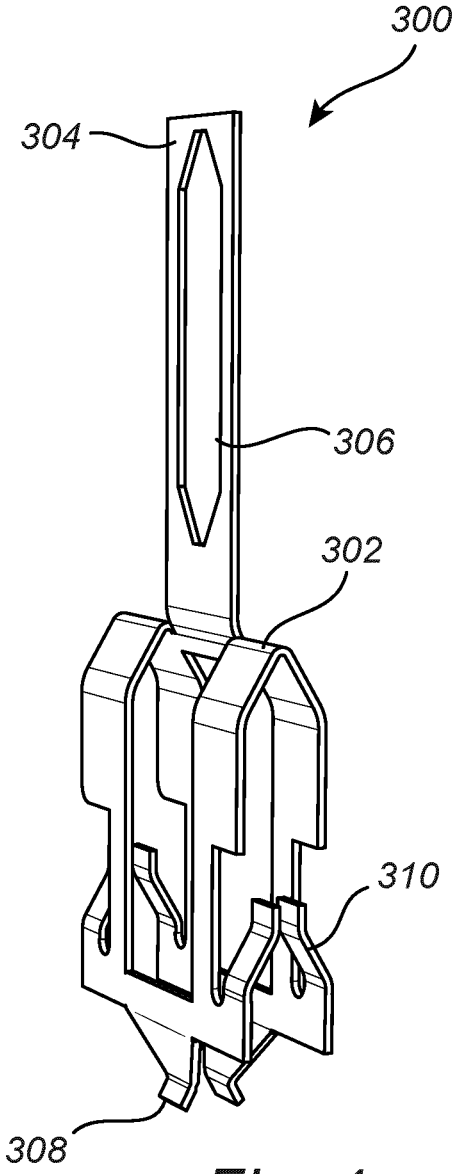
FIG. 4 discloses a perspective view of a connection clip.

In FIG. 4 is an embodiment of the connection clip 300 shown, the embodiment shares the features with the embodiment of FIG. 3 but is in addition provided with a registering element member 308. The registering element member 308 may be formed in one piece with the connection clip 300 or be attached thereto as a separate part.

The registering element member 308 is configured to engage with one of the plurality of openings 108 in the primary profile 100 (shown in FIG. 2), such that the connection clip 300 can be arranged aligned with a desired one of the openings 108. It is however to be realized that the registering element member 308 could also be used with any type of opening in the primary profile 100 into which the registering member 308 can fit.

The registering element member 308 is preferably resilient such that it can resiliently move into one of the plurality of openings 108 as the connection clip 300 is moved along the primary profile 100.

As can be seen in FIG. 4, the registering member 308 may be formed as a resilient portion extending from the base portion 302 of the connection clip 300, the registering member 308 pushing against the web 104 of the primary profile 100 as the connection element is moved along the primary profile 100 until the registering member 308 reaches one of the openings 108 and resiliently moves into said opening and indicating that the connection clip 300 is aligned with said opening 108.

Figure 5:
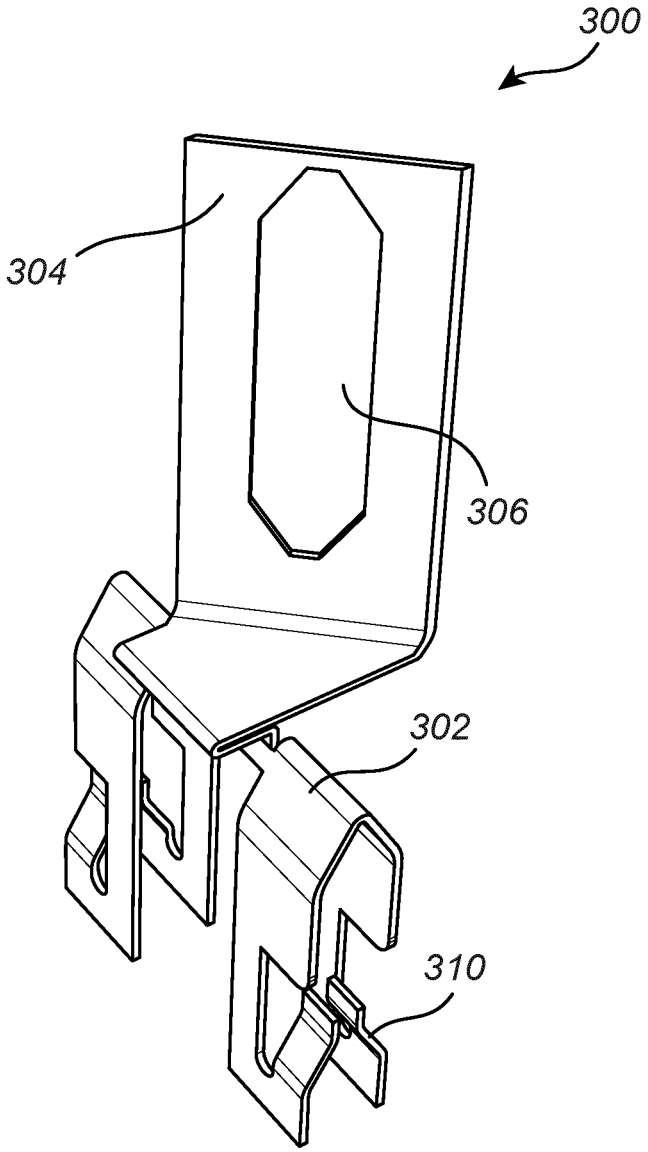
FIG. 5 discloses a perspective view of a connection clip.
Figure 6:
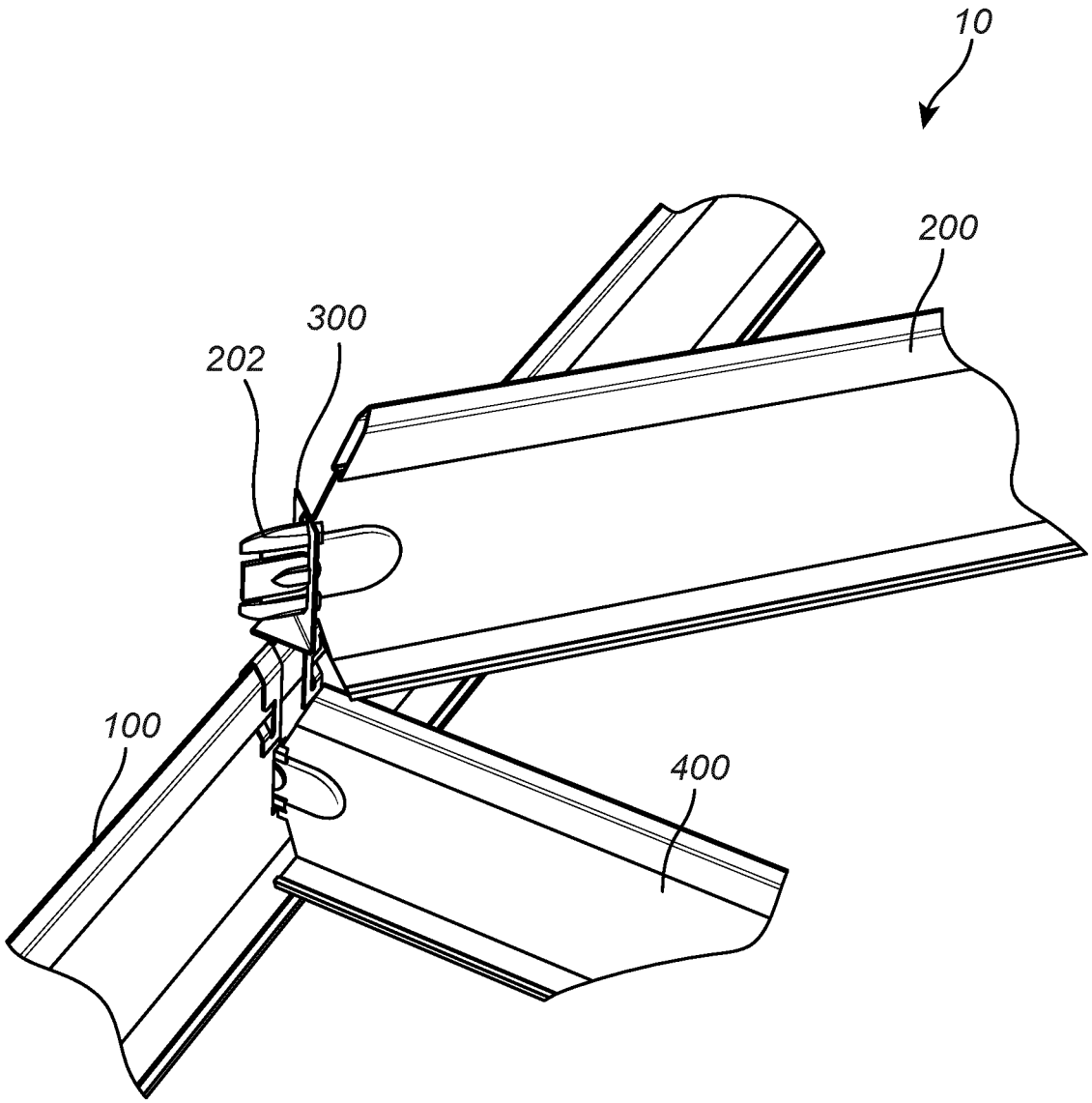
FIG. 6 discloses a perspective view of a grid of profiles provided with the connection clip of FIG. 5.

Turning to FIGS. 5 and 6 which show the connection clip 300 and the grid of profiles 10 in yet another embodiment. The embodiment illustrated in FIGS. 5 and 6, as is true for each of the embodiments disclosed herein, can be freely combined with the other embodiments disclosed herein unless explicitly stated otherwise.

In FIGS. 5 and 6, the opening 306 of the projecting flange 304 on the connection clip 300 is oriented such that the secondary profile 200 extends at an angle that is not perpendicular in relation to the primary profile 100. This allows the grid of profiles 10 to be adapted for instance if an obstacle prevents perpendicular extension of the secondary profiles 200.

The opening 306 can be arranged such the angle between the secondary profiles 200 and the associated primary profile 100 is between 10° and 80°, preferably approximately 45°. It is conceivable that the connection clip 300 can be manufactured in a number of variations with different angles for the orientation of the opening 306, for instance in 10° degree intervals which allows an appropriate connection clip 300 to be selected for the application at hand.

Figure 8:
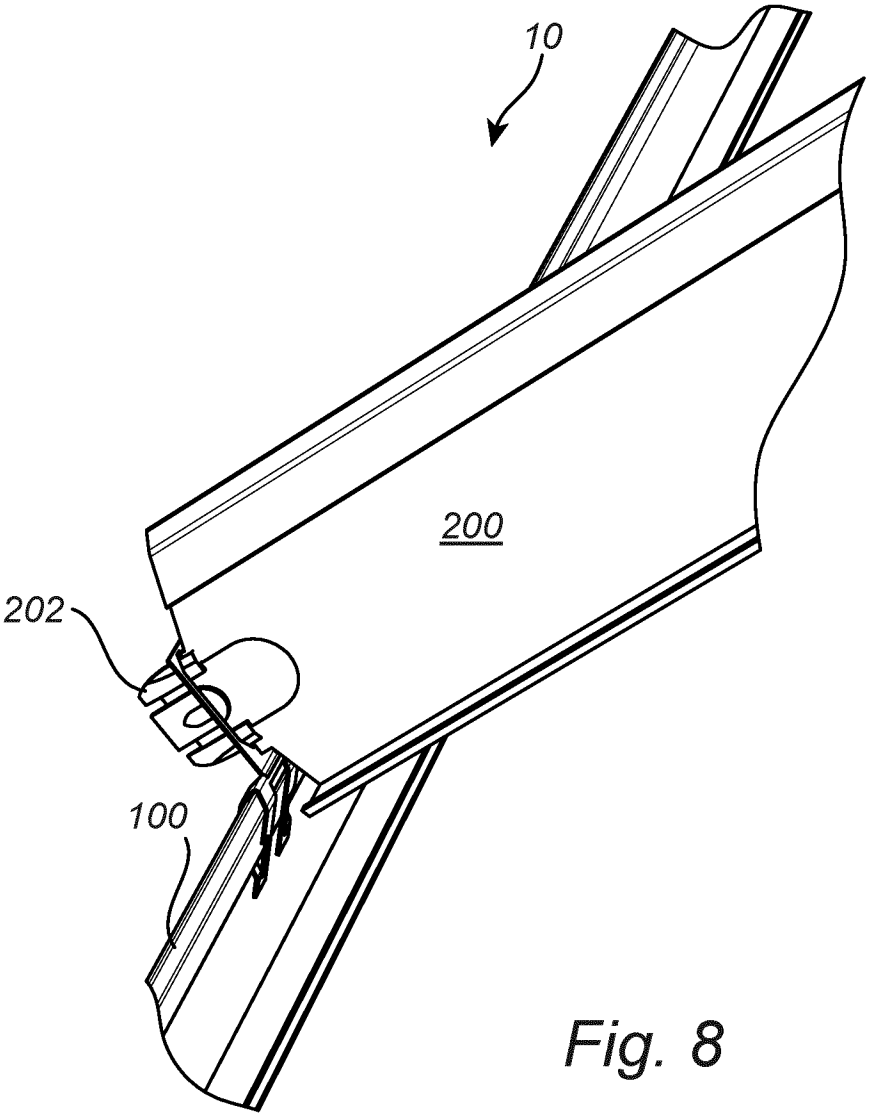
FIG. 8 discloses a perspective view of a grid of profiles provided with the connection clip of FIG. 7.
Figure 7:
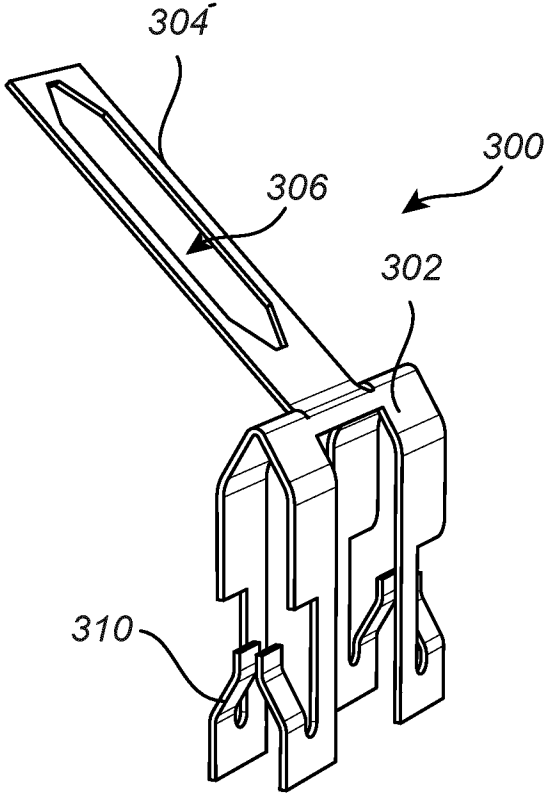
FIG. 7 discloses a perspective view of a connection clip.

In FIGS. 7 and 8, the opening 306 of the projecting flange 304 on the connection clip 300 is oriented such that the secondary profile 200 extends at a vertical angle in relation to the primary profile 100. The vertical angle of the secondary profile 200 in relation to the primary profile 100 provides improved flexibility to the grid of profiles 10, the secondary profiles 200 can extend such that they can connect to for instance a grid of profiles or to the building at a different level than that of the primary profiles 100 or the secondary profiles 200.

The opening 306 can be arranged such the vertical angle between the secondary profiles 200 and the associated primary profile 100 is between 5° and 90°. It is conceivable that the connection clip 300 can be manufactured in a number of variations with different vertical angles for the orientation of the opening 306, for instance in 10° degree intervals which allows an appropriate connection clip 300 to be selected for the application at hand.

The projecting flange 304 may further be configured such that it can be bent into the desired vertical angle by a technician during installation of the grid of profiles 10.

Figure 9:
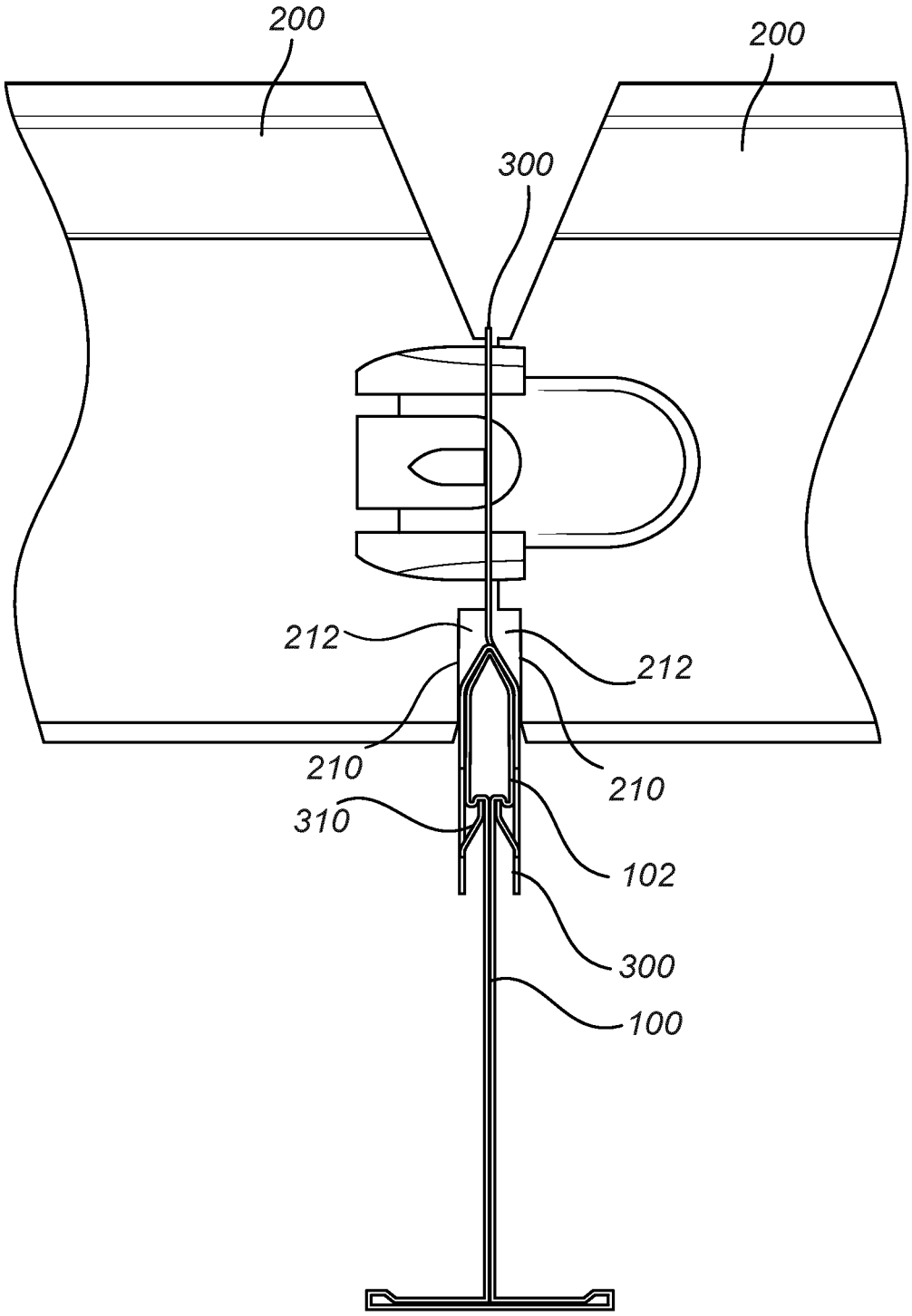
FIG. 9 discloses a side view of a grid of profiles.

FIG. 9 shows an embodiment of the grid of profiles 10 in which the opening 306 of the projecting flange 304 on the connection clip 300 is oriented such that the secondary profile 200 and the primary profile 100 vertically overlap. The secondary profiles 200 may be provided with an engagement surface 210, the engagement surface 210 forming a space 212 accommodating at least the upper portion of the primary profile 100. The space 212 may further accommodate the base connection clip 300. The horizontal distance between two engagement surfaces 210 on two opposing secondary profiles 200 is preferably larger than the width of the bulb portion 102 of the primary profile 100 provided with the connection clip 300, such that the secondary profiles 200 will not press against each other and buckle for instance due to thermal expansion.

The vertical overlap of the primary 100 and secondary 200 profiles provides increased rigidity to the grid of profiles 10, as a direct connection between the secondary profiles 200 and the primary profile 100 may be formed by the engagement surfaces 210 if the primary profile 100 moves laterally to either side. Movement of the secondary profiles 200 in the longitudinal direction can also be reduced, as the engagement surface 210 will contact the primary profile 100 and thus transfer forces directly to the primary profile 100 and not just via the connection clip 300.

It will be appreciated that the present invention is not limited to the embodiments shown. Several modifications and variations are thus conceivable within the scope of the invention which thus is exclusively defined by the appended claims.

The invention claimed is:

1. A grid of profiles for a suspended ceiling system comprising:

a primary profile provided with a bulb portion extending in a longitudinal direction of the primary profile, a secondary profile comprising a connector at an end of the secondary profile, and a connection clip comprising a base portion configured for mounting to the bulb portion of the primary profile and a projecting flange provided with an opening, the opening being configured for reception of the connector of the secondary profile from a first side of the projecting flange and also a connector of an opposing secondary profile from a second side of the projecting flange (304), wherein the connection clip is mounted to the bulb portion of the primary profile and the connector of the secondary profile is inserted into the opening (306) of the projecting flange such that the secondary profile is connected to the primary profile (100) via the connection clip at a secondary profile level which is different from a primary profile level in which the primary profile extends.

2. The grid of profiles according to claim 1, wherein the connection clip is snap fit mounted to the bulb portion of the primary profile.

3. The grid of profiles according to claim 1, wherein the primary profile has an inverted T-shaped profile with an upstanding web and laterally extending flanges, the bulb portion (102) being arranged at a free end of the web.

4. The grid of profiles according to claim 1, wherein the secondary profile has an inverted T-shaped profile with an upstanding web and laterally extending flanges.

5. The grid of profiles according to claim 1, wherein primary profile is provided with a plurality of openings distributed along the longitudinal direction of the primary profile, each opening being configured for connection of an additional profile to the primary profile at the primary profile level.

6. The grid of profiles according to claim 5, wherein each of the plurality of openings of the primary profile has the same configuration as the opening of the projecting flange of the connection clip.

7. The grid of profiles according to claim 5, wherein the opening of the projecting flange is aligned with one of the plurality of openings in the primary profile.

8. The grid of profiles according to claim 7, wherein the base portion of the connection clip comprises a registering element member configured to engage with one of the plurality of openings in the primary profile.

9. The grid of profiles according to any one of the preceding claim 1, wherein the connection clip is made out of metal.

10. The grid of profiles according to claim 1, wherein a ceiling tile is supported by the primary profile.

11. The grid of profiles according to claim 1, further comprising a plurality of primary profiles and a plurality of secondary profiles.

12. The grid of profiles according to claim 1, further comprising at least one suspension element connecting the primary profile to a structural ceiling.

13. The grid of profiles according to claim 1, wherein the opening of the projecting flange on the connection clip is oriented such that the secondary profile extends perpendicularly in relation to the primary profile.

14. The grid of profiles according to claim 1, wherein the opening of the projecting flange on the connection clip is oriented such that the secondary profile is vertically separated from the primary profile.

15. The grid of profiles according to claim 1, wherein the opening of the projecting flange on the connection clip is oriented such that the secondary profile and the primary profile vertically overlap.

16. The grid of profiles according to claim 1, wherein the opening of the projecting flange on the connection clip is oriented such that the secondary profile extends at a vertical angle in relation to the primary profile.

* * * * *